US005886715A

United States Patent [19]

Fukuoka

[11] Patent Number: 5,886,715

[45] Date of Patent: Mar. 23, 1999

[54] PRINT HEAD MAINTENANCE MECHANISM

[75] Inventor: Mutsuo Fukuoka, Ama-gun, Japan

[73] Assignee: Brother Kogyo Kabushiki Kaisha, Nagoya, Japan

[21] Appl. No.: 698,802

[22] Filed: Aug. 16, 1996

[30] Foreign Application Priority Data

Aug. 29, 1995 [JP] Japan ..... 7-245450

[51] Int. Cl.[6] ..... B41J 2/165

[52] U.S. Cl. ..... 347/33; 347/30

[58] Field of Search ..... 347/23, 30, 33, 347/90

[56] References Cited

U.S. PATENT DOCUMENTS 5,245,362 9/1993 Iwata et al. ..... 347/23

FOREIGN PATENT DOCUMENTS 3-218846 9/1991 Japan ..... 347/23

*Primary Examiner*—Benjamin R. Fuller
*Assistant Examiner*—Craig A. Hallacher
*Attorney, Agent, or Firm*—Oliff & Berridge, PLC

[57] ABSTRACT

A print head maintenance mechanism used for an inkjet printer including a print head having a nozzle plateformed with nozzles and a head transport mechanism capable oftransporting the print head along a transport pathway from aprint region to a non-print region, the print head ejecting ink contained in an ink cartridge from the nozzles onto a print sheet while in the print region, the print head maintenance mechanism including: a purge unit disposed in confrontation with the non-print region of the transport pathway and for sucking ink from the nozzles of the head when needed; and a wiper unit disposed in confrontation with the non-print region of the transport pathway and wiping the nozzle plate only after the purge unit has sucked ink from the nozzles.

19 Claims, 4 Drawing Sheets

PRINT HEAD MAINTENANCE MECHANISM

BACKGROUND OF THE INVENTION

1. Field of the Invention

The present invention relates to a print headmaintenance mechanism for cleaning a print head having anozzle plate formed with nozzles.

2. Description of the Related Art

There has been known an ink jet type printer for recording images on a print sheet. While a print head formed with nozzles is in a print region and is confronting the print sheet, ink is ejected from the nozzles to print an image on the print sheet. In between printing operations, the print head is moved to a waiting position, where the purge mechanism caps the nozzles of the print head to prevent ink in the nozzles from drying out. The purge mechanism also sucks defective ink and debris from the nozzles to unclog the nozzles. The ink jet printer is also provided with a wiping unit for wiping the nozzle plate of the print head using a rubber wiper blade. When the print head is moved from the waiting position to a position in the print region, the nozzle plate of the print head contacts and is wiped by the wiper blade. The reason the nozzle plate of the print head is wiped is because after purge operations ink droplets can remain clinging to the nozzle plate of the print head. These ink droplets can interfere with proper ejection of ink droplets.

SUMMARY OF THE INVENTION

However, with this maintenance mechanism, wipingoperations are performed each time capping operations are performed, even though the suction operations by the purge unit need not be performed. A water repellent coating is formed on the surface of the nozzle plate in order to insure proper ejection of ink droplets. Because wiping operations are performed so often, that is, between printing operations, this repellent coating peels off fairly rapidly so that quality of the nozzle plate suffers.

It is an objective of the present invention to overcome the above-described problems and to provide an ink jet maintenance mechanism which performs wiping operations by the wiping device only after the purge unit performs suction operations. With this sequence, the number of wiping operations can be reduced to a minimum amount so that quality of the nozzle plate can be maintained.

To achieve the above-described objectives, a print head maintenance mechanism according to the present invention is used for an ink jet printer including a print head having a nozzle plate formed with nozzles and a head transport mechanism capable of transporting the print head along a transport pathway from a print region to a non-print region, the print head ejecting ink contained in an ink cartridge from the nozzles onto a print sheet while in the print region and the print head maintenance mechanism including: a purge unit disposed in confrontation with the non-print region of the transport pathway and for sucking ink from the nozzles of the head when needed; and a wiper unit disposed in confrontation with the non-print region of the transport pathway and wiping the nozzle plate only after the purge unit has sucked ink from the nozzles.

With this configuration, the wiper unit performs wiping operations only after the purge unit operates purge operations. Therefore, the number of the wiping operations can be reduced to a minimum so that deterioration of quality of the nozzle plate can be prevented.

According to another aspect of the present invention, a method of maintaining proper operation of a print head having a nozzle plate formed with nozzles and movable along a transport path between a print region and a non-print region of a printer includes the steps of: sucking ink from the nozzles when needed; and wiping the nozzle plate with a wiper blade only after ink is sucked from the nozzles.

BRIEF DESCRIPTION OF THE DRAWINGS

The above and other objects, features and advantagesof the invention will become more apparent from reading thefollowing description of the preferred embodiment taken in connection with the accompanying drawings in which.

DETAILED DESCRIPTION OF THE PREFERRED EMBODIMENTS

Figure 1:
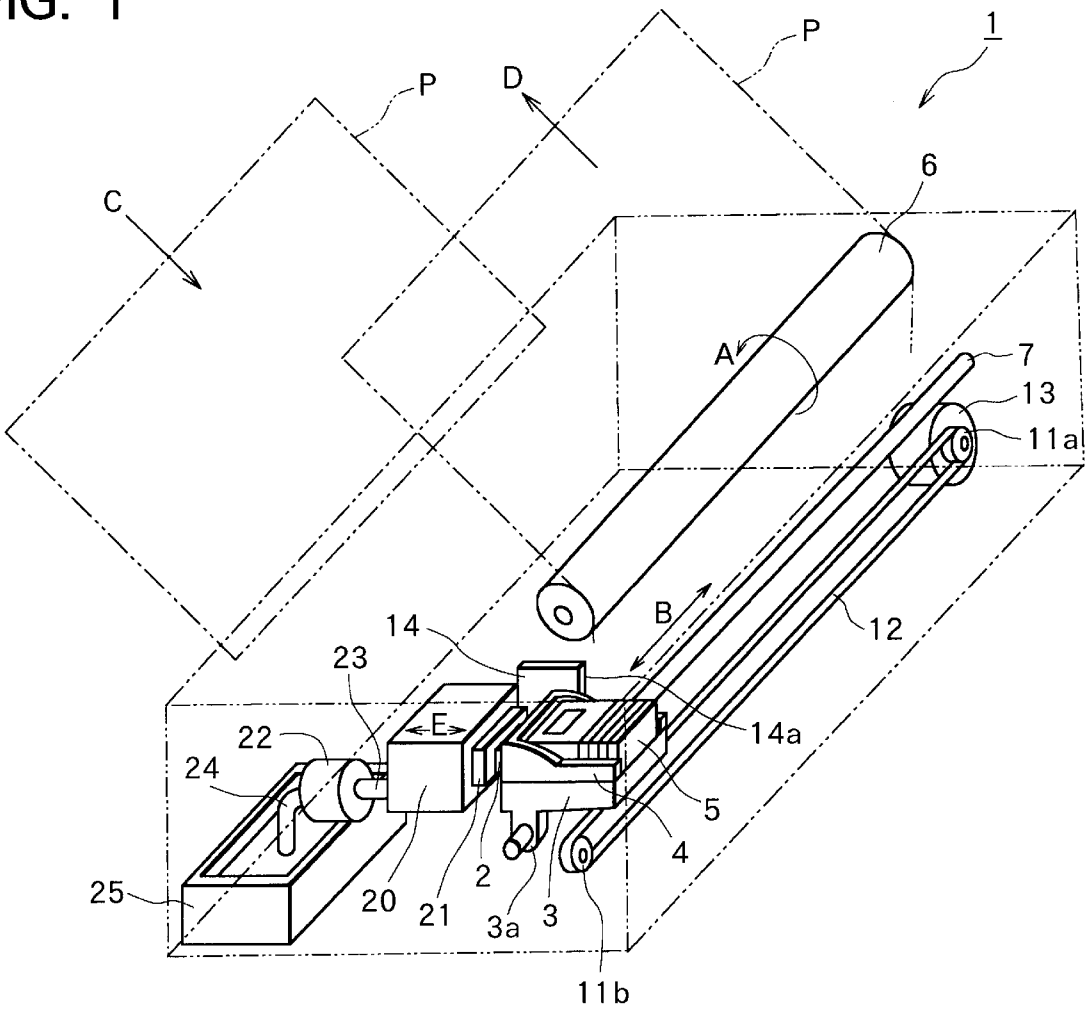
FIG. 1 is a perspective view partially in phantom showing an ink jet printer including a print head maintenance device according to a first embodiment of the present invention.

A print head maintenance mechanism according to afirst embodiment of the present invention will be describedwhile referring to the accompanying drawings wherein likeparts and components are designated by the same reference numerals to avoid duplicating description.

FIG. 1 is a perspective view schematically showing an ink jet printer 1 in which is mounted an ink jet maintenance mechanism according to the first embodiment of the present invention. The ink jet printer 1 includes a print head 2 for ejecting ink onto a printing medium such as a print sheet P. The print head 2 is integrally formed with a head unit 4 supported on a carriage 3. An ink cartridge 5 for supplying ink to the print head 2 is freely detachably mounted to the carriage 3. The print head 2 has a nozzle plate treated with water repellent material for preventing ink from clinging its surface. The print head 2 includes piezoelectric elements which generate displacement when applied with a voltage. Ink is ejected from the print head 2 by a pumping action obtained by this displacement. Printing can be performed by ejection of ink droplets from the print head. It should be noted that thermal elements could be used in the print head 2 instead of the piezoelectric elements.

A carriage shaft support portion 3*a* of the carriage 3 is mounted on a shaft 7 so that the carriage 3 can be reciprocally driven in directions indicated by an arrow B. A platen roller 6 is freely rotatably disposed in confrontation with the front surface of the print head 2 when the print head 2 is in the print region. The platen roller 6 extends parallel to the reciprocal directions B in which the carriage 3 is driven. The print head 2 and the platen roller 6 comprise a print portion. A belt 12 is suspended between a pair of pulleys 11*a,* 11*b.* The pulley 11*a* is driven by rotation of a motor 13. Because the carriage 3 is connected to the belt 12, rotational drive of the motor 13 reciprocally and linearly drives the carriage 3. This in turn transports the print head 2 along a transport pathway in the print region and in a non-print region adjacent to the print region.

A sheet-supply cassette (not shown in the drawings) is provided to the upper rear of the ink jet printer 1. A print sheet P is supplied in a direction indicated by an arrow C from the sheet-supply cassette. The print sheet is transported between the print head 2 and the platen roller 3, which is driven to rotate in a direction indicated by an arrow A. After the print sheet is printed on, it is discharged in a direction indicated by the arrow D. The mechanism for supplying and transporting the print sheet P has omitted from FIG. 1.

A wiper unit 14 provided with a wiper blade 14*a* for cleaning the print head 2 is provided to the side of the platen roller 6 in the non-print region. When the print head 2 moves from a waiting position in the non-print region to the print region, the wiper blade 14*a* wipes across the surface of the print head 2 and removes residual ink and paper residue from the nozzle plate of the print head 2. Further, when the print head 2 moves from the print region to the waiting position in the non-print region, the wiper blade 14*a* is drawn back to a position where it cannot contact the print head 2. Therefore, wiping operation are not performed when the print head moves from the print region to the waiting position.

The purge unit 20 is provided to the side of the platen roller 6 at a position in confrontation with the waiting position of the print head 2. During printing, bubbles can be generated inside of the ink jet print head 2. Also, ink droplets can cling to ejection surface of the print head 2. These can result in defective ejection of the ink droplets. The purge unit 20 is for improving ejection of ink droplets and for returning the print head to a proper operating condition. A cap 21 reciprocally movable in the directions indicated by arrow E is provided to the tip of the purge unit 20. The purge unit 20 moves the cap 21 toward the print head 2 to cover the print head 2 by the cap 21. At this time, a pump 22 operates to generate a negative pressure in the cap 21. Defective ink in the print head 2 is suctioned from the nozzles of the head and through the pipes 23, 24 so that the print head 2 returns to proper operating condition. Defective ink suctioned in this manner is accumulated in the tank 25.

Figure 2:
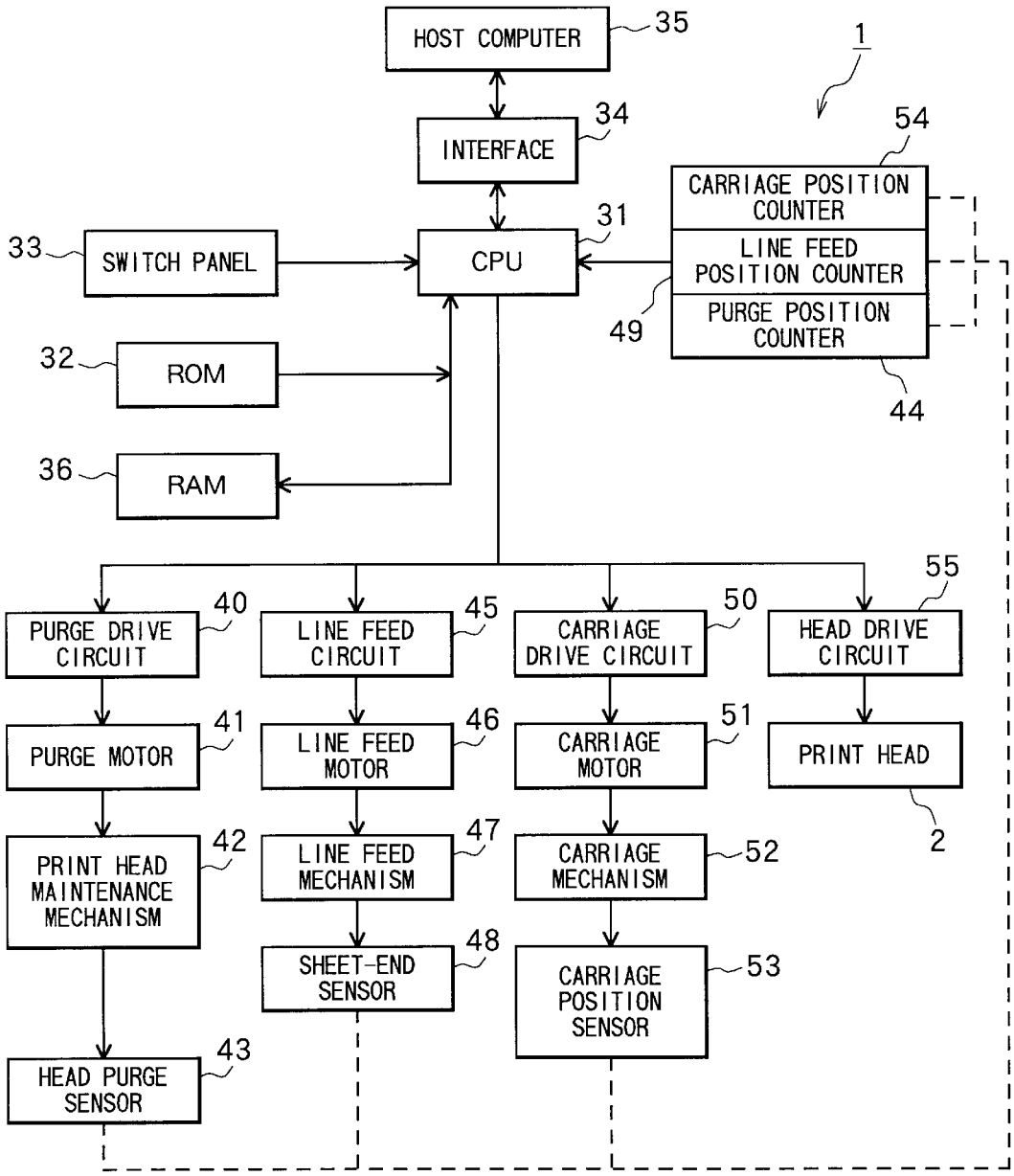
FIG. 2 is a block diagram showing electrical connection between components of the ink jet printer and between the ink jet printer and a host computer.

An explanation for electrical connection between components of the ink jet printer 1 will be provided while referring FIG. 2. FIG. 2 is a block diagram showing system configuration of a host computer 35 and an ink jet printer 1. A central processing unit (CPU) 31 is provided for performing overall control of the ink jet printer 1. A ROM 32 connected with the CPU 31 is provided for storing programs necessary for controlling operations of the CPU 31. A RAM 36 is also connected with the CPU 31. The CPU 31performs control operation based on external commandsinputted from a switch panel 33 also connected to the CPU 31and based on print data inputted from the host computer 35via an interface circuit 34. Print data inputted from the host computer 35 is converted into a format appropriate for printing and stored then in the ROM 32.

The CPU 31 is connected to a purge drive circuit 40 for driving a purge motor 41. The purge motor generates rotational force for operating a print head maintenance mechanism 42 including the purge unit 20 and the wiper unit 14. The CPU 31 controls drive of the purge motor 41 via the purge drive circuit 40, thereby controlling the suction operations of the purge unit 20. A head purge sensor 43 connected to the print head maintenance mechanism 42 detects operation of the purge unit 20. To prevent erroneous operation of the purge unit, and to insure correct positioning between the print head 2 and the purge unit, a purge position counter connected to the head purge sensor 43 counts the number of operations performed by the purge unit 20 based on detection signals from the head purge sensor 43. The suction operations of the purge unit 20 and the wiping operations of the wiper unit 14 are controlled by a sequence of operations in the CPU 31.

Similarly, the CPU 31 controls drive of a line feed motor 46 via a line feed circuit 45, thereby controlling operation of a sheet feed mechanism 47 including the platen roller 6. The sheet supply condition of the sheet feed mechanism 47 is detected by a sheet-end sensor 48 connected to the line feed mechanism 47. A line feed position counter 48 connected to the sheet-end sensor 48 counts the line feed condition of the line feed mechanism 47 based on signals from the sheet-end sensor 48.

In the same manner, the CPU 31 controls drive of a carriage motor 51 via a carriage drive circuit 50, thereby controlling a carriage mechanism 52 including the carriage 3. Operations of the carriage 3 are detected by a carriage position sensor 53 and counted by a carriage position counter 54.

Operations of the print head maintenance mechanism 42, the line feed mechanism 47, and the carriage mechanism 52 are ganged controlled by the CPU 31 based on values stored in the purge position counter 44, the line feed position counter 49, and the carriage position counter 54. In this way, a series of operations of the ink jet printer 1 are performed. Further, drive of the print head 2 is controlled by a print head drive circuit 55 based on values stored in the purge position counter 44, the line feed position counter 49, and the carriage position counter 54.

Figure 3:
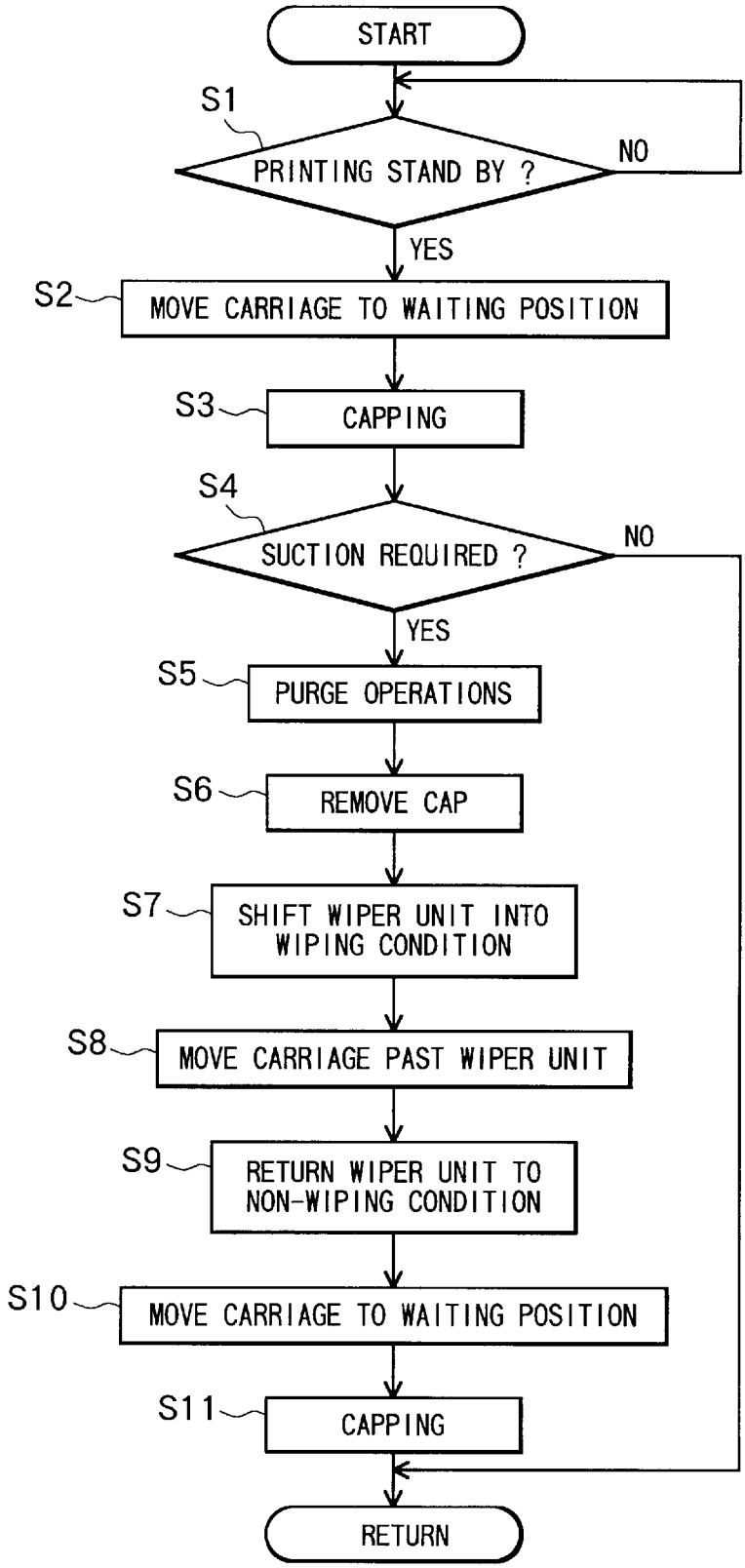
FIG. 3 is a flowchart showing sequence of processes performed regarding the print head maintenance device in a central processing unit cording to the first embodiment.

Next, an explanation will be provided for a sequence for controlling suction operations of the purge unit 20 and wiping operations of the wiper unit 14 in the print head maintenance mechanism 42. FIG. 3 is a flowchart showing this sequence. Individual steps of this sequence will be referred to in FIG. 3 and in the following text as Si, wherein i is an individual step. When printing is performed using the print head 2, whether or not printing is temporarily stopped is determined in S1. If so (S1:YES), then in S2 the carriage 3 is moved to the waiting position where the print head 2 confronts the purge unit 20. Afterward, capping is performed in S3.

Then, whether or not suction operations need to be performed by using the purge unit 20 is determined in S4. Timing of purging operations as determined in S4, that is, whether or not purging operations need to be performed by the purge unit 20 can be determined in a variety of ways. For example, the program running the CPU 31 can be designed so that S4 will result in a positive determination when the accumulative amount of time that printing operations have been performed reaches a predetermined time duration of time or when the number of dots printed reaches a predetermined number of dots. If purging is determined to be required (S4:YES), then a purging operation is undertaken in S5. If not (S4:NO), this sequence is ended.

Then, the cap 21 is separated from the print head 2 in S6. The wiper unit 14 is then in S7 shifted toward the transport pathway of the print head 2, that is, from its non-wiping condition wherein the wiper is withdraw from the transport pathway into its wiping condition wherein the wiper protrudes into the transport pathway. Rotational force of the purge motor 41 can shift the wiper unit 14 between its non-wiping condition and its wiping condition by reciprocally moving the wiper unit 14 in the directions indicated by the arrow E in FIG. 1 or by tilting the wiper unit 14 toward the transport pathway of the print head 2. Then the carriage 3 is moved toward the wiper unit 14 in S8. When the carriage 3 moves past the wiper unit 14, the wiper is wiped against the nozzle plate of the print head 2. Afterward, the wiper unit 14 is returned back to its non-wiping condition in S9. Then, the carriage 3 is moved back to the waiting position in S10. Next, the cap 21 is moved back into abutment with the print head 2 to cover the nozzles in S11.

By controlling operations of the purge unit 20 and the wiper unit 14 using this sequence of processes, the wiper unit 14 wipes the print head 2 only after suction operations are performed by the purge unit 20. Therefore, the number of times wiping is performed can be reduced to a minimum so that the water repellent coating on the nozzle plate is not damaged and the quality of the nozzle plate can be maintained.

While the invention has been described in detail with reference to specific embodiments thereof, it would be apparent to those skilled in the art that various changes and modifications may be made therein without departing from the spirit of the invention, the scope of which is defined by the attached claims.

For example, in the sequence performed by the CPU 31 according to the first embodiment, directly after suction operations are performed by the purge unit 20 in S5 of FIG. 3, the carriage 3 is moved to a predetermined position so that wiping can be performed in S8. However, the carriage 3 need not be moved directly after suction operations have been completed. Instead, the carriage can be temporarily stopped until start of the next printing operation. At the start of the next operation, the wiper unit 14 can be shifted into its wiping posture so that wiping is performed when the print head 2 moves to the print region and passes by the wiper of the wiper unit 14.

Figure 4:
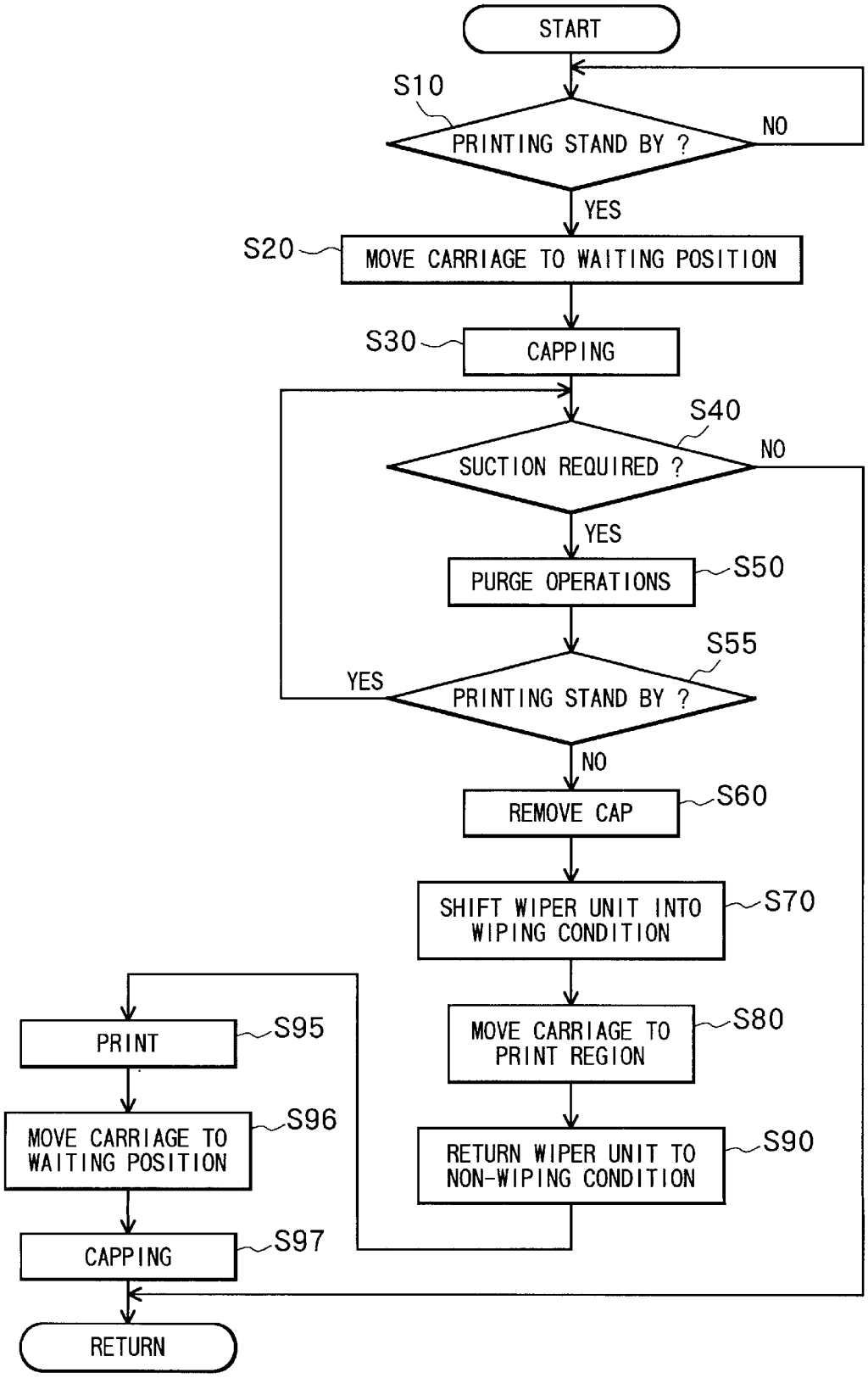
FIG. 4 is a flowchart showing sequence of processes performed regarding the print head maintenance device in a central processing unit according to of a second embodiment.

Here an explanation for a print head maintenance mechanism according to a second embodiment of the second invention will be provided while referring to the flowchart in FIG. 4. FIG. 4 is a flowchart representing a sequence of operations controlled by the CPU 31 according to the second embodiment. Operations and their sequence performed by the CPU 31 according to the second embodiment are similar to those described in the first embodiment while referring to FIG. 3. However, after purge operations are performed in S50, whether or not the print head maintenance mechanism 42 is in a printing stand by mode is determined in S55. The print head maintenance mechanism 42 is in the printing stand by mode while the CPU 31 awaits a print command and print data from the host computer 35, that is, while awaiting start of a subsequent printing operation. If the print head maintenance mechanism 42 is in the printing stand by mode (S55:YES), then the routine returns to S40. If not (S55:NO), then capping is released in S60 and the wiper unit 14 is shifted into its wiping condition in S70. Then, in S80 the carriage 3 is moved toward the print region, whereupon the wiper of the wiper unit 14 wipes the nozzle plate as the print head passes by the wiper unit 14. Then, the wiper unit 14 is returned to its non-wiping condition in S90 and printing operations are started in S95. The carriage 3 is then moved to the waiting position in S96 and capping again performed in S97.

With a printing head maintenance mechanism according to the present invention, the wiper unit wipes the print head only after purge operations have been performed by the purge unit. In this way, the number of the wiping operations can be reduced to a minimum so that the quality of the nozzle plate can be prevented from deteriorating.

What is claimed is:

1. A print head maintenance mechanism used for an ink jet printer including a print head having a nozzle plate formed with nozzles and a head transport mechanism capable of transporting the print head along a transport pathway from a print region to a non-print region, the print head ejecting ink contained in an ink cartridge from the nozzles onto a print sheet while in the print region, the print head maintenance mechanism comprising:

a purge unit disposed in confrontation with the non-print region of the transport pathway and for sucking ink from the nozzles of the head when needed;

a wiper unit disposed in confrontation with the non-print region of the transport pathway and wiping the nozzle plate only after the purge unit has sucked ink from the nozzles; and a controller unit operationally coupled to the wiper unit which holds the wiper unit in a non-wiping position at all times other than after the purge unit has sucked ink from the nozzles, the non-wiping position being a position in which the nozzle plate is not wiped.

2. A print head maintenance mechanism as claimed inclaim 1, wherein the wiper unit includes a wiper blade and ashift mechanism, the shift mechanism being capable of shifting the wiper unit between a non-wiping condition wherein the wiper blade is withdrawn back from the transport pathway and a wiping condition wherein the wiper blade protrudes into the transport pathway, the shift mechanism shifting the wiper unit into the wiping condition only after the purge unit has sucked ink from the nozzles.

3. A print head maintenance mechanism as claimed in claim 2, wherein the wiper unit is disposed between the purge unit and the print region and wipes the nozzle plate when the print head moves along the transport pathway from the non-print region toward the print region past the wiper unit while the wiper unit is shifted into the wiping condition.

4. A print head maintenance mechanism as claimed in claim 3, further comprising control means for sequentially controlling:

the purge unit to suck ink from the nozzles;

the wiper unit to shift into its wiping condition after the purge unit sucks ink from the nozzles; and the head transport mechanism to move the print head toward the print region and past the wiper unit after the wiper unit shifts into the wiping condition.

5. A print head maintenance mechanism as claimed in claim 4, wherein the control means controls:

the wiper unit to return to the non-wiping condition after the print head is moved past the wiper unit; and the head transport mechanism to move the print head back to the purge unit after the wiper unit returns to the non-wiping condition.

6. A print head maintenance mechanism as claimed in claim 5, further comprising a control unit controlling:

the purge unit to suck ink from the nozzles when needed after completion of a first print operation; and the shift mechanism to shift the wiper unit into the wiping condition and the head transport mechanism to move the print head to the print region past the wiper unit after a second print operation is started after the first print operation.

7. A print head maintenance mechanism as claimed in claim 2, wherein the shift mechanism shifts the wiper unit from the non-wiping condition to the wiping condition by tilting the wiper unit.

8. A print head maintenance mechanism as claimed in claim 2, wherein the shift mechanism shifts the wiper unit between the non-wiping condition and the wiping condition by reciprocally moving the wiper unit.

9. A print head maintenance mechanism as claimed in claim 2, further comprising control means for controlling:

the purge unit to suck ink from the nozzles;

the wiper unit to shift into the wiping condition after the purge unit sucks ink from the nozzles;

the head transport mechanism to move the print head toward the print region and past the wiper unit after the wiper unit shifts into the wiping condition;

the wiper unit to return to the non-wiping condition after the print head has moved past the wiper unit; and the head transport mechanism to move the print head back to the purge unit after the wiper unit returns to the non-wiping condition.

10. A print head maintenance mechanism as claimed in claim 1, wherein the wiper unit is disposed between the purge unit and the print region and wipes the nozzle plate when the print head moves along the transport pathway from the non-print region toward the print region past the wiper unit.

11. A print head maintenance mechanism as claimed in claim 10, further comprising control means for sequentially controlling:

the purge unit to suck ink from the nozzles; and the head transport mechanism to move the print head toward the print region and past the wiper unit after the purge unit sucks ink from the nozzles.

12. A print head maintenance mechanism as claimed in claim 1, further comprising control means for sequentially controlling:

the purge unit to suck ink from the nozzles; and the head transport mechanism to move the print head toward the print region and past the wiper unit after the purge unit sucks ink from the nozzles.

13. A print head maintenance mechanism as claimed in claim 1, further comprising control means for controlling the wiper unit to wipe the nozzle plate only after the purge unit has sucked ink from the nozzles as needed.

14. A print head maintenance mechanism as claimed in claim 13, wherein the control means further determines need to suck ink from the nozzles according to an amount of time printing has been performed using the print head.

15. A print head maintenance mechanism as claimed in claim 13, wherein the control means further determines need to suck ink from the nozzles according to a number of dots ejected by the print head.

16. A method of maintaining proper operation of a print head having a nozzle plate formed with nozzles and movable along a transport path between a print region and a non-print region of a printer, the method comprising the steps of:

sucking ink from the nozzles when needed;

wiping the nozzle plate with a wiper blade only after ink is sucked from the nozzles; and controlling the wiper blade such that the wiper blade is in a non-wiping position at all times other than after ink is sucked from the nozzles, the non-wiping position being a position in which the nozzle plate is not wiped.

17. A method as claimed in claim 16, wherein the step of sucking ink from nozzles includes the steps of:

moving the print head from the print region to a waiting position in the non-print region;

covering the nozzles of the nozzle plate with a cap;

determining the need for sucking ink from the nozzles; and sucking ink from the nozzles via the cap when needed.

18. A method as claimed in claim 17, wherein the step of wiping the nozzle plate includes the steps of:

removing the cap from the nozzle plate;

shifting the wiper blade into the transport path of the print head;

moving the print head past the wiper blade;

shifting the wiper blade back to an original position of the wiper blade;

returning the print head to the waiting position; and again covering the nozzles of the nozzle plate with the cap.

19. A method as claimed in claim 17, wherein the step of wiping the nozzle plate includes the steps of:

awaiting start of a subsequent printing operation of the printer;

removing the cap from the nozzle plate upon start of the subsequent printing operation;

shifting the wiper blade into the transport path of the print head;

moving the print head past the wiper blade to the print region: and shifting the wiper blade back to an original position of the wiper blade.

* * * * *